United States Patent [19]

Laub, III

[11] 4,095,628

[45] Jun. 20, 1978

[54] ANTIDRIP VOLUMETRIC RAPID FILLING MACHINE WITH ANTIFOAMING FEATURE AND SIMPLIFIED CONTROL VALVE

[76] Inventor: Herman Laub, III, 244 N. San Marino, San Gabriel, Calif. 91775

[21] Appl. No.: 723,774

[22] Filed: Sep. 16, 1976

[51] Int. Cl.[2] ..... B65B 3/32

[52] U.S. Cl. ..... 141/367; 137/625.48; 222/249; 222/564

[58] Field of Search ..... 137/202, 625.48, 625.49; 141/37, 44–46, 48, 59, 61, 65, 85–88, 93, 94, 99, 100, 128, 138–152, 156–162, 177, 351, 352, 360, 362, 369, 372, 374, 115, 367; 222/249, 250, 477, 564; 239/569

[56] References Cited

U.S. PATENT DOCUMENTS

| | | | |
|---|---|---|---|
| 3,388,720 | 6/1968 | Parr | 137/625.48 |
| 3,426,799 | 2/1969 | Kinter | 137/625.48 |
| 3,870,089 | 3/1975 | Laub | 141/115 X |
| 3,918,475 | 11/1975 | Trusselle | 141/128 |

*Primary Examiner*—Richard E. Aegerter
*Assistant Examiner*—Frederick R. Schmidt
*Attorney, Agent, or Firm*—Peter I. Lippman

[57] ABSTRACT

This device for rapid and extremely accurate filling of bottles includes means for decreasing the dispensing flow rate during particular phases of each fill. This feature minimizes foaming of dispensed fluids when the filling operation proceeds into the portion of each bottle wherein conditions are conductive to foaming, while maintaining a rapid fill rate for other portions of each bottle. The device also has a novel spool valve for control of flow between supply, metering device and bottle: this valve has a hollow-centered spool, the hollow center providing in one operational configuration a fluid-flow bypass which reduces the number of ports and connections outside the valve barrel.

31 Claims, 8 Drawing Figures

SUBSTANCE SUPPLY
COMPRESSED AIR
VACUUM
P

ANTIDRIP VOLUMETRIC RAPID FILLING MACHINE WITH ANTIFOAMING FEATURE AND SIMPLIFIED CONTROL VALVE

SUMMARY OF THE INVENTION

This invention relates to the filling of containers, such as bottles, with flowable substances ranging from very viscous to very thin and including substances which readily form suds or foam.

My invention provides very rapid fluid flow into such containers but, in order to minimize the tendency of the fluid to form foam, provides a decreased flow rate when the fluid level in each container reaches the portion of the container at which the shape of the bottle, the fluid characteristics and the configuration and sequencing of the dispensing apparatus are conducive to foaming.

Accordingly, for some situations the flow rate is decreased at the tapered, decreasing-radius portion of the container near the container mouth. In some instances it is useful to reduce the flow near the container mouth even if the mouth is not constricted. In other circumstances it is useful to reduce the flow at sections of a container remote from its mouth: in a "wasp-waist" bottle, for instance, the flow rate can be reduced for filling the constricted, central portion of the bottle; whereas for certain fluids it is necessary to use a "bottom filler" whose nozzle is placed near the bottom of the inside of each container, and even so the fluids foam when the fluid level is below the nozzle opening, if flow rates are too high — so it is advantageous to reduce the flow rate for filling in the bottom of such containers, below the nozzle opening.

My invention thus reduces foaming in all these situations, while maintaining the average flow for the entire bottle at a relatively very high rate.

Throughout the specification and claims hereof, the words "foam" and "foaming" are to be understood to have somewhat specialized meanings, which go beyond the usual connotation of forming a light, harmless surface froth. "Foam" and "foaming" herein relate to entrainment of air within the substance dispensed, thereby introducing a volume error; and also to generating surface activity of sufficient vigor to displace dispensed substance up and out of the mouth of a container, producing a further volume error.

My invention also provides a relatively simple, compact and reliable valve device for controlling flow of the fluid to be dispensed, in two different paths simultaneously, thereby reversing the flow connections to a metering-cylinder-and-piston apparatus which is biacting — that is, which dispenses fluid during both strokes of the piston, from a supply of the substance into containers to be filled.

Through advantageous combination and coordination of these principles and features, the present invention makes possible an improved combination of high average filling speed, volumetric precision and accuracy, and equipment reliability and maintainability not previously realized.

The first mentioned feature of my invention (decreased flow rate at end of fill cycle) may advantageously be embodied in a metering-cylinder-and-piston apparatus, in which the piston drives fluid through a port near or in an end wall of the cylinder: means for controlling the flow rate of the fluid are then simply actuated in response to proximity of the end surface of the piston to the end wall of the cylinder.

However, my invention may also be embodied in any system for dispensing controlled volumes of substance into containers. In general the flow rate is decreased or restricted in response to some indication that a particular portion of the filling cycle has been reached at which the filling system is susceptible to foaming — such as, in some instances, the "end" of the filling cycle, the "end" being understood to mean that portion of the cycle which fills the neck or other top portion of each container. In other instances, other portions of the cycle may be more susceptible to foaming, as described hereinabove.

In the case of the metering-cylinder-and-piston apparatus, flow-rate control means disposed either inside or outside the cylinder restrict the flow rate of the fluid through the port when the piston is within a specified distance of the end wall. The flow rate under this condition is controllable from outside the cylinder, even while the apparatus is operating, so that the operator of the equipment can provide the maximum filling rate consistent with foamless operation — for a great variety of different container sizes and shapes. This apparatus can be used to limit the flow rate at the beginning of the fill as well as at the end, if desired, when used with biacting pistons.

The result of limiting the flow rate at particular portions of each container is actually to *increase* the average filling speed greatly. This is explained in the following paragraphs.

Filling speed is enhanced in the present invention by segmenting the filling process into two procedures: (1) filling where the system and container are relatively less susceptible to foaming (e.g., in most bottles, below the neck of the container) and (2) filling where the system and container are relatively more susceptible to foaming (e.g., in the neck of the container). The first of these procedures may proceed at a much faster flow rate than the second, and usually involves transfer of a much larger volume of fluid than the second; yet in prior-art devices the flow rate appropriate to the second procedure has been used for both procedures.

With my present invention each procedure is conducted at the maximum rate permissible for that procedure, and the average flow rate more closely approaches the rate permissible for the less foam-susceptible portion (e.g., the body) of the bottle than it approaches that for the more foam-susceptible portion (e.g., the neck).

As an example, consider a particular container whose neck contains 5% of the total volume of the container, and suppose that foam prevention requires a flow rate in the neck which is 30% of that permissible below the neck. Simple arithmetic shows that filling the entire bottle at the rate dictated by foaming requirements in the neck will take 2.99 times as long as filling both parts of the bottle at respectively appropriate rates.

In one specific embodiment of my invention the flow-limiting element is disposed within the cylinder, being compliantly supported from the end surface of the piston, and adapted and positioned to engage the port and throttle the port down when the end surface of the piston is within the desired distance from the end wall of the cylinder.

In particular the flow-limiting element in one embodiment is in the form of a washer, mounted at one end of a spring, and the other end of the spring is attached to the end surface of the piston. The washer contacts the end wall of the cylinder, at a portion of the end wall which is contoured to receive and seal against the washer — so that fluid can flow only through the central hole of the washer. This central hole is made smaller in diameter than the diameter of the port.

Furthermore in this same embodiment a beveled-tip screw is threaded through a hole in the end wall of the cylinder, so that it protrudes through the port which is formed in the inside end wall of the cylinder. This screw is positioned in alignment with the central hole of the washer, and may be screwed in or out by the equipment operator from outside the cylinder. The beveled tip of the screw may in this way be brought into nearly complete engagement with the central hole of the washer; in this way the central hole of the washer may be throttled down to a continuously variable degree, from substantially unrestricted to substantially obstructed.

The second-mentioned feature of my invention (valve apparatus for simultaneously controlling fluid flow in two paths simultaneously) is based upon a novel spool-valve configuration in which the fluid flow in one operating arrangement passes along a central hollow core of the valve spool, thus internalizing a flow path (between two necked-down portions of the spool) which in prior-art devices must be made outside the valve barrel.

The result of this construction is a reduction in the number of external ports, connections and tubes to be provided, and connected and disconnected in maintenance of the apparatus; as well as a reduction in the number of potential sources of leaks. Access to the equipment is improved, visibility of the various external valve parts (which is important to maintaining cleanliness, an essential to detection of incipient leaks and therefore to maintaining volumetric precision) is improved, and simplicity of maintenance procedures is improved.

Consequently the combination of the two features of the present invention produces a previously unobtainable combination of high average filling speed, plug high precision and accuracy (obtained through the anti-foam effects of the selective flow reduction), plus equipment reliability and easy maintainability. This combination of characteristics is the primary aim of the present invention.

BACKGROUND OF THE INVENTION

The present invention is an improvement on my earlier invention described and claimed in my U.S. Pat. No. 3,870,089, issued Mar. 11, 1975, the disclosure of which is hereby incorporated by reference in the present disclosure.

That earlier disclosure amply explains the goals of combined precision and accuracy with filling speed, and enunciates a combination of principles which taken together provide rapid but extremely accurate filling — considerably beyond the speed and accuracy standards previously considered the state of the art.

The present invention, though it produces another significant increment in combined speed and accuracy along with improved reliability, is designed for use within the same context and generally with the same system-connection arrangement as described in the above-identified patent.

Accordingly the explanation of the abovementioned goals, enunciation of principles, and system-connection arrangement are not all repeated in toto, but only to an extent deemed necessary to clarify the present invention.

The present invention provides an added increment of performance, plus equipment simplicity and serviceability, beyond the performance attainable with the invention described in my patent. Needless to say, a high level of serviceability or maintainability can be directly translated, over the life of a piece of equipment, into yet further improvements in longterm average filling speed: the number of bottles which can be filled per mouth or years bears an inverse relation to the amount of "down" time of any filling apparatus.

The principles and features introduced above and their advantages may be more fully understood through consideration of the embodiments hereinafter described in detail, with reference to the accompanying drawings of which:

Such multiple-head systems are illustrated and described in my above-identified patent, and it is intended that the devices of the present disclosure be substitutable, with minor appropriate rearrangements or readjustments, for the corresponding devices of that patent disclosure.

DESCRIPTION OF EMBODIMENTS

Figure 1:
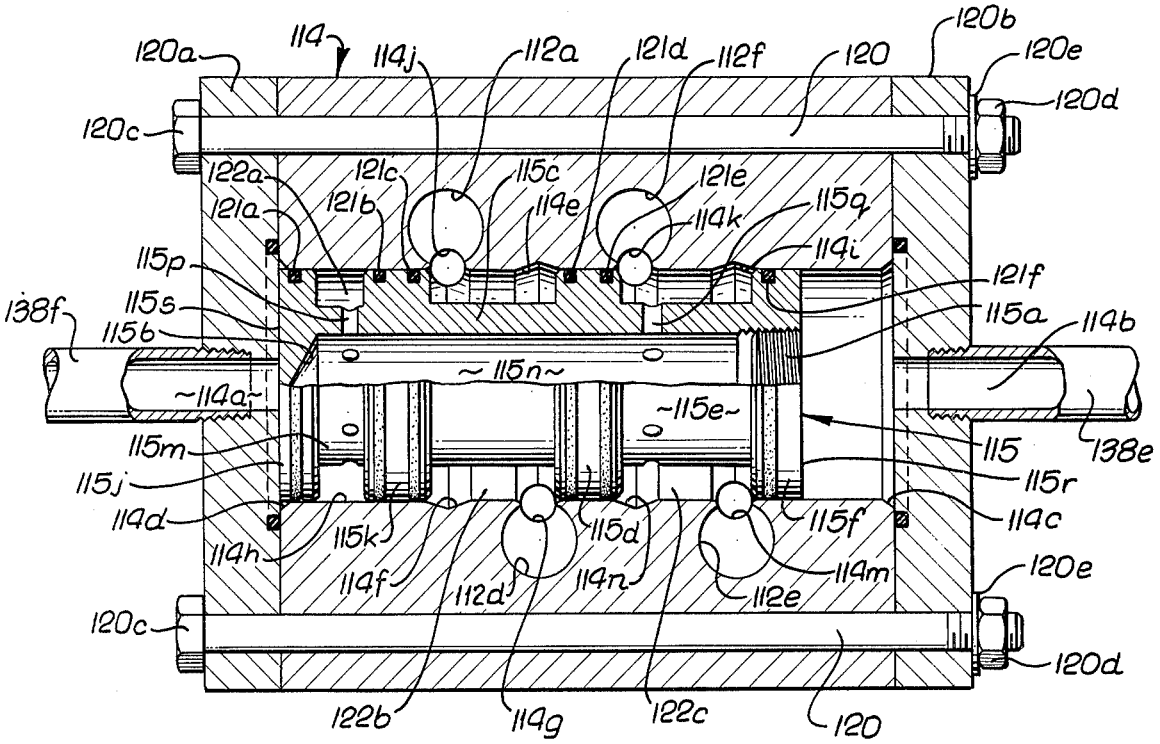
FIG. 1 is a drawing in section showing the configuration of the spool valve.

As shown in FIG. 1, the spool valve assembly consists of two basic parts — the valve spool 115, shown partly in section (top half) and partly in elevation, and the valve barrel 114 with end-plates 120*a* and 120*b* (the barrel and end-plates being shown in section).

The spool 115 is cylindrically symmetrical except for the radial holes 115*p* and 115*q*. The spool has four "lands," or wider-diameter sections, 115*j*, 115*k*, 115*d* and 115*f*, each provided with one or two O-ring grooves (illustrated but not numbered) for retaining O-rings 121*a* through 121*f* which effect compliant seal against the cylindrical inner wall 114*h* of the spool barrel.

Between the lands the spool has necked-down portions 115*m*, 115*c*, and 115*e* which form with the inner cylindrical wall of the barrel annular cavities 122*a*, 122*b* and 122*c* respectively, which as will be seen communicate with ports in the valve barrel and provide fluid flow paths between certain of the ports under certain circumstances. The ends of each land are beveled to minimize the damage in event abrasive contaminants pass through the valve with the fluid being dispensed, as well as damage in assembly.

The spool also has a hollow center running along its length; the inner cylindrical wall of the hollow center is identified in FIG. 1 as 115*n*. The inner void is conveniently formed by drilling an axial hole from one end of the spool (the right end, as illustrated here), so that the central void typically terminates in a conical or otherwise tapered shape 115*b* at the "bottom" (left end, as illustrated here) of the spool, just past the location of the radial holes 115*p*. The other end of the central cavity is conveniently formed by a plug 115*a* permanently fixed within the end of the cylindrical hole 115*n*. The axial length of the plug is limited by the consideration that it not obstruct the radial holes 115*q*.

Thus the hollow central bore formed by the cylindrical wall 115*n*, the tapered end-wall 115*b* and the plug 115*a* provides, in cooperation with the multiplicity of radial holes 115*p* and 115*q*, direct communication for fluid flow at any time between annular cavities 122*a* and 122*c*.

The spool barrel is advantageously formed from a block of plastic or metal 114 which is rectangular externally, but in which is provided a hole 114*h* which is cylindrically symmetrical except for access holes 114*g*, 114*j*, 114*k* and 114*m* drilled generally tangent to the cylindrical surface 114*h*.

The inner wall 114*h* is a right-cylindrical surface except for six sections which taper outwardly. Two of these are conical sections 114*c* and 114*d*, at the ends of the barrel 114, which help to compress the O-rings into place when the spool is inserted into the barrel from either end, as well as providing relief for purposes of minimizing damage during assembly. The other four outwardly tapered sections are double-conical protrusions 114*f*, 114*e*, 114*n* and 114*i* which intersect respectively the access holes 114*j*, 114*g*, 114*k* and 114*m*. These access holes are drilled into the block from the "other" or "back" side as viewed in FIG. 1, and plugs (not illustrated) are inserted to close the ends of the access holes. Thus the access holes only serve as intermediate flow paths between the double-conical outwardly tapered protrusions 114*f*, 114*e*, 114*n* and 114*i* and the larger port holes 112*a*, 112*d*, 112*f* and 112*e*, respectively, these larger port holes being drilled in from "this" or the "front" side of the block as viewed in FIG. 1.

While the cylindrically shaped port holes 112*a* et al. could be drilled in directly to intersect cylindrical surface 114*h*, without the intermediary of the access holes 114*j* et al. and double-conical outwardly tapered protrusions 114*f* et al., there are several practical difficulties with such an arrangement. For one, the O-rings tend to "hang up" on the abrupt corners formed by the intersections of the cylindrical surfaces; the outward-tapered sections of the wall adjacent the points where the ports enter alleviate this problem. Further, the large port holes form with the cylindrical surface 114*h*, and even with the outwardly tapered protrusions, a compound surface whose size and even shape are extremely sensitive to the location of the port-hole centerlines. Further, with some materials and spacings, the shape of the compound surfaces at the intersections of the cylindrical cavities may be conducive to a tendency of the material to break away in operation, producing very unsatisfactory irregular surfaces as well as material fragments. The smaller access holes serve as pilot holes which because of their size (1) can be more accurately located with respect to the surface 114*h* and (2) produce, in intersection with the cylindrical surface 114*h*, a compound surface whose size and shape varies less strongly with position. The generally cylindrical barrel 114*h*, 114*d*, 114*f*, 114*e*, 114*n*, 114*i* and 114*c* is closed at its ends by end-plates 120*a* and 120*b*, secured in position by bolts 120*c* and nuts 120*d*, provided with washers 120*e*. The end-plates 120*a* and 120*b* are penetrated by pneumatic-system access holes 114*a* and 114*b* respectively, into which pneumatic tubing connections 138*f* and 138*e* are respectively secured. Positive air-pressure differential applied through tube 138*e* to the end 115*r* (including the end of plug 115*a*) of the spool, relative to the pressure applied through 138*f* to the other end 115*s* of the spool, drives the spool to the left (as viewed in FIG. 1) into the position illustrated, wherein the annular cavity 122*b* provides communication between ports 112*a* and 112*d*, while the annular cavity 122*c* provides communication between ports 112*f* and 112*e*. While the central bore and the annular cavity 122*a* communicate, via radial holes 115*p* and 115*q*, with the annular cavity 122*c* they do not serve as a fluid flow path when the spool is in the position illustrated, inasmuch as cavity 122*a* is not itself juxtaposed to any valve port.

When positive pressure is applied through 138*f* to the other end 115*s* of the spool, relative to the pressure applied through 138*e* to end 115*r*, the spool is driven to the right (as to the orientation in FIG. 1) into a position in which port 112*a* communicates with port 112*e* via annular cavity 122*a*, holes 115*p*, the central bore 115*n*, holes 115*q*, and the annular cavity 122*c*, in that order; while ports 112*f* and 112*d* communicate via annular space 122*b*. This is more-explicitly illustrated and described hereinafter.

Although not illustrated herein, isolation of the pneumatic system from the fluid flow paths may be provided as explained in my aforementioned patent.

Figure 1A:
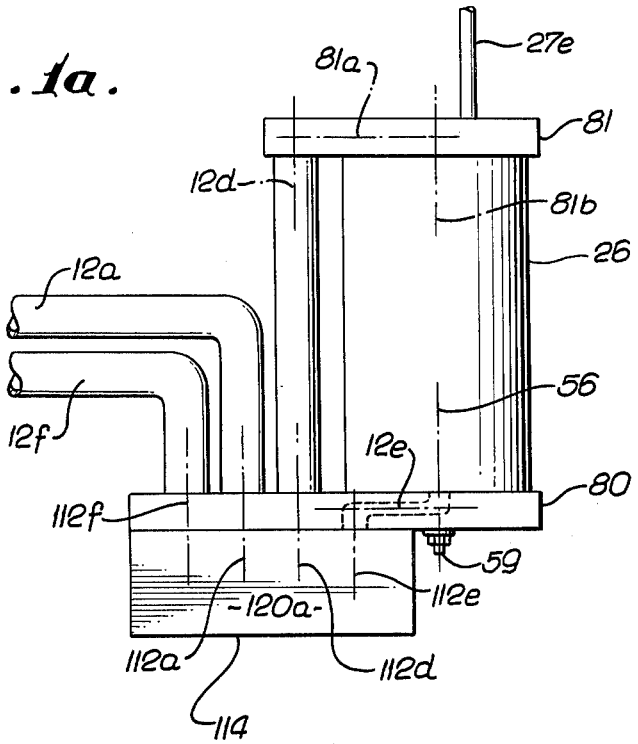
FIG. 1*a* is an elevation drawing showing the connections between the spool valve and the dispensing nozzle, fluid supply, and metering chamber.

Connection of the valve ports in FIG. 1 to the supply, dispensing nozzle and metering chamber is achieved by bolting the valve assembly to the bottom of the metering chamber, which has one corresponding port in its bottom; this and the other connections may advantageously be made as shown in FIG. 1*a*.

FIG. 1*a* shows the valve assembly of FIG. 1 in connection with certain other components of the system, particularly metering cylinder 26. In this figure, the valve assembly is seen "end-on" from the left of the assembly as drawn in FIG. 1, so that only end-plate 120*a* of the assembly can be seen, the body 114 and other end-plate 120*b* of FIG. 1 being behind plate 120*a* in FIG. 1*a*. The centerline symbols marked 112*e*, 112*f*, 112*d* and 112*a* illustrate in a schematic way the locations of the centers of the correspondingly numbered ports of FIG. 1: in actual practice one or more of these holes may well be directly behind others, but for clarity the locations are here shown as laterally separated. These vertical port holes are all continued into and through the adapter plate 80 of FIG. 1*a*, except for vertical port hole 112*e* which terminates inside the adapter plate 80. The port hole 112*e* does however communicate with a short horizontal bore 12*e* (corresponding to tube 12*e* of FIG. 2) within plate 80, and this in turn communicates with a vertical bore 56 (corresponding to port 56 of FIG. 2) in the top portion of plate 80. The manner in which the port 56 is used within the cylinder 26 is an essential feature of one embodiment of my invention, and is described in detail hereunder with reference to FIG. 2. The protruding slotted screw end 59 is also involved in this feature and explained hereunder. The necessity for the horizontal offset bore 12a between ports 112a and 56 will be clear in view of that text hereunder.

While the bottom of metering cylinder 26 seals against adapter plate 80, which in fact forms the bottom closure of the cylinder, the top of the cylinder seals against a top plate 81 which forms the top closure of the cylinder. Tubulation 12d provides communication between port hole 112d and a horizontal bore 81a in top plate 81, and thence with a vertical bore 81b within the bottom half of top plate 81; vertical bore 81b in turn opens into the top of the metering cylinder.

Figure 2:
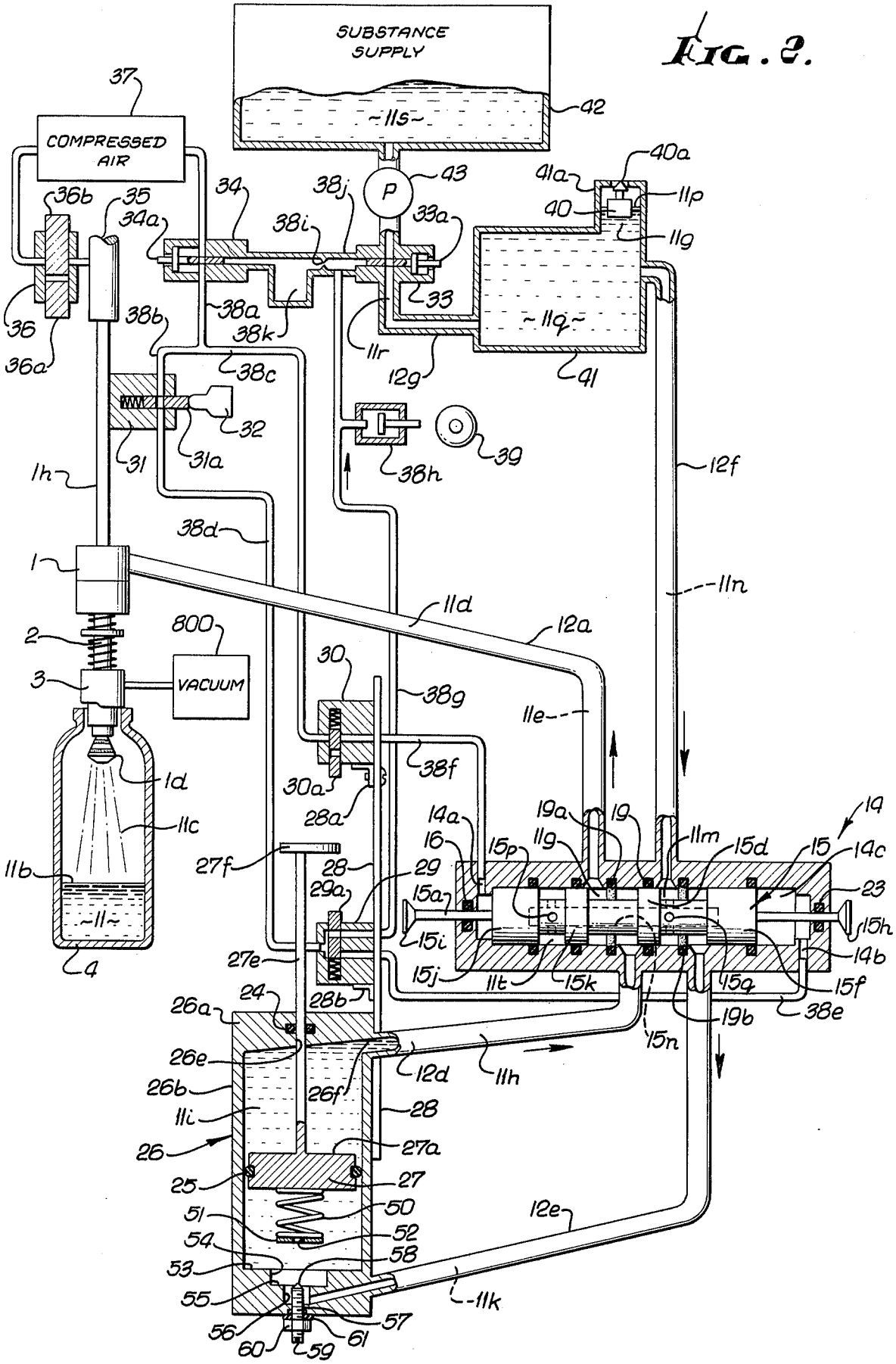
FIGS. 2 and 2*a* through 2*e* are drawings mostly in section and partly in elevation showing the configuration of the various parts, and the interconnections of these parts, which form one embodiment of the present invention, specifically one in which a biacting metering piston and cylinder are used to control product volume dispensed, and in which pneumatic valves are employed as sensors to control system sequencing. These illustrations represent the operation of a "single-head" system, that is, a system having only one piston and one nozzle, for filling one bottle at a time; these illustrations also represent one head of a multiple-head system, that is, a system having a multiplicity of pistons each with its respective nozzle and sharing a common supply and certain other elements for filling a multiplicity of bottles concurrently or even simultaneously.

FIG. 2 shows a one-filling-head system (also representable as one head of a multiple-head system) in the context of FIG. 2 of my prior patent. FIG. 2 herein is exactly the same as FIG. 2 of the prior patent except as to the details of the spool valve 14 and metering chamber 26, and the tubing connections between the spool valve and the dispensing nozzle assembly 1, 2 and 3.

Briefly, substance 11s from the supply 42 passes pressure regulator 43 and incomplete-fill automatic shutdown valve 33, with reset button 33a, and tubulation 11r, to air de-entrainment vessel 41 with dome section 41a adapted to trap and accumulate air bubbles in the space above liquid level 11p. Liquid 11q within the dome section supports float 40 to engage valve 40a with its seat until the level 11p falls below a particular height, at which point excess air blows off at valve 40a permitting the float 40 and valve 40a to return upward to a closed condition.

Fluid with most of the entrained air removed proceeds at 12f into annular space 11m within spool valve 14. For ease of comparison the spool valve is here drawn generally as in my patent, though it embodies the principles illustrated and discussed hereinabove in connection with FIG. 1 hereof.

With the spool in the position shown in FIG. 2, the fluid passes from annular void 11m via tube 12e into port section 56 of the metering chamber 26.

The piston 27, sealed at 25 against the cylinder walls, slides up or down in response to fluid entering at 56 or at 26f, respectively, impelling fluid out of the chamber at 26f or 56, respectively. When fluid enters at 56, fluid exits at 26f via tube 12d to annular cavity 11g within the spool valve, and thence via tube 12a to the dispensing-nozzle assembly 1, 2 and 3. As the piston 27 rises during this dispensing operation, rod 27e (sealed at 24 in the top end-wall of the cylinder) also rises, carrying actuating member 27f into contact with button 30a of pneumatic switch 30. When button 30a is pressed, compressed air from supply 37 flows by incomplete-fill automatic shutdown valve 34 (with reset button 34a) and via tubing 38a and 38c and the aforementioned valve 30 into tubing 38f and port 14a of the spool valve, impelling the spool 15 fully to the right (with respect to the illustration of FIG. 2) within the spool barrel, to the position shown in FIG. 2e.

In this rightward position, fluid entering from tube 12f flows via annular cavity 11g formed between lands 15d and 15k directly to tube 12d, reversing the direction of the metering piston so that the piston moves downward, propelling fluid outward via port 56 and tube 12e to annular space 11m formed between lands 15d and 15f, and thence to radial holes 15q into central bore 15n of the spool, then out through radial holes 15p into the annular space 11t between lands 15j and 15k, now aligned with tube 12a. Fluid then proceeds out through tube 12a to the dispensing assembly 1, 2 and 3 as is the case with the spool in the first position discussed.

In short, the spool valve reverses the connections to the metering cylinder while preserving the directionality of fluid flow from supply to dispensing nozzle — in effect controlling the flow of fluid in two paths simultaneously.

As explained fully in my previously mentioned patent, element 32 of FIG. 2 is a CONTAINER READY cam which actuates button 31a of pneumatic switch 31 so that penumatic selector switch 29 receives excitation pressure only when a container is ready to be filled. If button 31a is depressed when the metering piston is not fully down, ready to begin a new fill, then pressure is applied through line 38d and pneumatic switch 29 to line 38g, which shuts down the fluid supply at switch 33, rings a bell 39 at actuator 38h, and then shuts down the air supply itself via pneumatic switch 34, actuated via a time-delay system composed of constriction 38i and pneumatic capacitive vessel 38k.

Button 36a of pneumatic switch 36 applies compressed-air pressure to air cylinder 35 to raise the dispensing assembly 1, 2 and 3 by means of support shaft 1h, and button 36b of switch 36 deactivates the air cylinder 35 so that the dispensing assembly can descend into the next container.

Element 1 of FIG. 2 is a supply body, attached by an internal centerpin to tip 1d. The supply body and tip coact with supply sleeve 2 and selectable orifices within the supply body and springs surrounding supply sleeve 2 to permit fluid flow at controlled rates from tube 12a into container 4 at 11c, providing a rising level 11b of fluid 11 in the container. Further, element 3 is a vacuum hood which draws off spray and droplets via vacuum supply 800 and small conduits within tip 1d, under various conditions — all as detailed in my aforementioned patent.

By comparison of the tubulation configuration of FIG. 2 with that of the corresponding figure in my previously mentioned patent, it will be seen that the central bore 15n of the valve spool 15 permits elimination of a tube which appears in FIG. 2 of my patent, as element 12c of that figure. This external simplification has several advantages in terms of visibility of the apparatus for leak inspections, fewer potential leak locations, and ease of assembly and disassembly — translatable into a lower percentage of "down" time and thus higher longterm-average filling rates.

Within the metering chamber 26, and attached to the bottom surface of piston 27, is a compliant member such as stiff spring 50. Suspended at the other end of this spring is an annular disc — i.e., a washer — 51, with central hole 52.

Internal end-wall 53 of the cylinder 26 is contoured by provision of recess 54 therein, which in turn has end-surface 55. Within end-surface 55, port 56 is provided communicating with tubulation 12e. When the piston descends toward end-wall 53, annulus or "washer" 51 enters recess 54, and when the piston is above recess end-wall 55 by a distance equal to the length of spring 50 plus the thickness of washer 51 the washer seats against surface 55. Thereafter, as the spring compresses while the piston continues to descend, the washer 51 remains seated against end-surface 55. During this time the flow into port 56 must pass through an area which is reduced relative to the cross-sectional area of the port itself — specifically, it must pass through the area of the central hole 52 in the washer 51.

The effective cross-sectional area of the fluid flow path is further reduced by protrusion of the beveled tip 58 of screw 57 into the central hole 52 of the washer 51. Screw 57 is threaded through a hole in the end wall 53 of the cylinder, the hole being located within the recess 54 and in fact within the port 56. The extent to which the tip 58 protrudes into the central hole 52 may be adjusted by rotation of the slotted end 59 of screw 57, which is accomplished from outside the chamber and in fact may be accomplished even while the apparatus is in operation. Once satisfactory adjustment is obtained the screw may be secured in position by use of lock nut 60, which seats against thread seal 61, the latter being provided to eliminate fluid leakage from the cylinder via the threads of the screw 57 and its matching threaded hole.

By screwing the screw 57 in so that the beveled tip nearly contacts the central hole 52 of the washer, the equipment operator can produce extremely slow flow; in fact the rate may be continuously adjusted all the way to zero, substantially. By screwing the screw 57 out so that the beveled tip is separated from the plane of the washer by a distance on the order of the diameter of the central hole in the washer, or any greater distance, the operator can produce a flow rate which is substantially unaffected by the adjustment screw, and limited only by the diameter of the hole in the washer. The adjustment is continuous from the latter rate which is controlled only by the diameter of the hole in the washer to the previously mentioned substantially zero rate, though of course the proportional change per amount of rotation of the screw increases greatly as the zero-flow setting is approached.

Since the overall pressure drop from supply 42 to container 4 is essentially unchanged by action of the washer 51 seating against surface 55, or by the position of tip 58 with respect to the hole in the washer, and since the system resistance to fluid flow is affected by restriction of the cross-sectional area at washer 51 and tip 58, the fluid flow rate is effectively controlled by the cross-sectional area restriction. The velocity of the piston is itself controlled by the flow rate, so the piston velocity at the end of its downward stroke — when the washer 51 is seated against the end-surface 55 — is also controlled by the cross-sectional area restriction.

The stiffness of spring 50 may be chosen in relation to the fluid supply pressure so that when the piston begins its upward stroke the pressure of fluid **11*k* entering the port via tube 12*e* lifts the washer out of the recess 54, so that fluid can bypass the central hole in the washer. This may be done if desired to avoid the unnecessary slowing of the fill rate when the liquid level is at the bottom of the container 4**.

However, in some circumstances, as previously noted herein, it is desirable also to slow the fill at the bottom of the container: this would dictate choice of a stiffer spring 50. (If desired to slow the fill *only* at the bottom of the container, this may be accomplished by a rearrangement of the parts — as, for example by mounting the spring and washer to the end-wall 53, providing passageways within piston 27, and providing a relatively light spring. However, there would appear to be better ways to accomplish this aim, as described below.)

The length of spring 50 may be chosen (or forcibly changed) in relation to the shape of the container 4, if desired, so that the flow-restriction mechanism comes into operation earlier or later in the fill cycle as appropriate to match, for example, the point at which the liquid level in the container enters the tapered narrower "neck" of the particular container.

While I have found it advantageous to put the above-described limiting mechanisms inside my metering cylinder, my invention is not limited to that embodiment. In particular, an adjustable valve may be placed at any point along the fluid flow path, and a fully-opening valve such as a gate valve placed in parallel across the adjustable valve; and the gate valve may be controlled pneumatically, electrically or otherwise by signals derived from the piston position — such as, for example, switches placed for actuation by member **27*f* which is attached by rod 27*e* to the piston 27. When the piston is below a certain level, member 27*f* or other switch-controlling means can operate switching devices to close the gate valve, so that all fluid flow is forced to pass through the adjustable valve, which throttles down the flow as desired. When the piston is above that certain level, member 27*f* or other switch-controlling means can operate switching devices to open the gate valve, so that fluid flow may pass substantially without restriction through the gate valve as well as the adjustable valve. Through further logic switching, to restrict flow only at the top of the container, the gate valve may be made to close on the piston downstroke when the actuating member 27*f* is below a certain level, but open on the upstroke regardless of the position of the actuating member 27*f***; or vice versa to restrict flow only at the bottom of the container.

In place of the two-valve-in-parallel system just described, it is also satisfactory to provide a selector valve which switches the fluid flow between one path which passes through an adjustable valve and another path which is substantially unrestricted.

Another alternative is to provide a single, variable-restriction valve controlled by a custom cam — with the cam in turn being driven by rod **27*e* or actuator 27*f***, or the like.

These alternative systems (for limiting the flow by means external to the cylinder) all in common have the advantage, relative to the system illustrated, that the portion of the stroke during which the flow-restricting mechanism comes into operation can be made selectable and adjustable from outside the cylinder, during operation, as well as the rate to which the flow is restricted.

Furthermore, these alternative systems may be used in apparatus which uses some metering arrangement other than a metering cylinder — if some suitable means of indicating the onset of the foam-susceptible portion of the fill cycle (e.g., the "end" as previously defined herein) can be provided.

These alternative systems are, however, disadvantageous in external complexity of the system, potential leak sources, and so forth as previously discussed in relation to simplicity of the spool valve external arrangement.

Figure 2A:
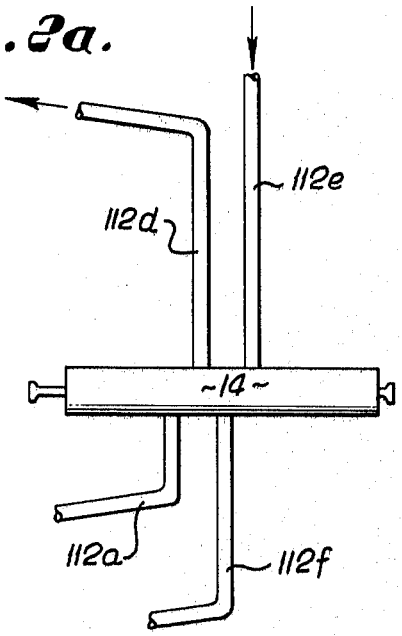

FIGS. **2*a* through 2*d* show other configurations of the tubing connection to the spool valve 14. FIG. 2*a* indicates that the spool can be operated with the connections to the supply and the dispensing nozzle exchanged as a pair with the connections to the two ends of the metering cylinder. In other words, the tube connected to the top of the cylinder is tube 12*a* of FIG. 2 (identified as 112*a* in FIG. 2*a*) instead of tube 12*d*, which now (identified as 112*d* 112*d*** in FIG. 2*a*) is directed to the dispensing nozzle; while the tube which goes to the bottom of the metering cylinder is tube 12*f* of FIG. 2*a* (here identified as 112*f*) instead of tube 12*e* (here identified as 112*e*), which now is connected to the supply.

Figure 2B:
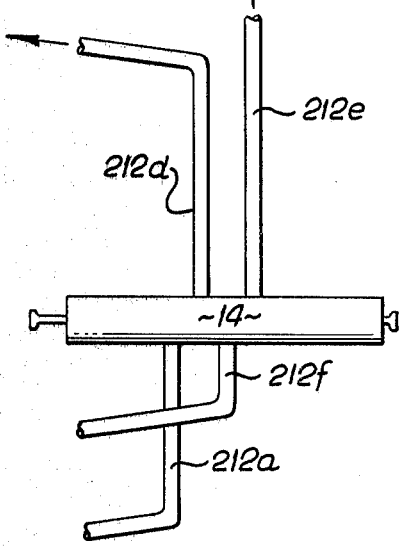

FIG. 2*b* indicates that the connections 112*d* and 112*e* of FIG. 2*a* to supply and dispensing nozzle can be retained (here identified as 212*e* and 212*d*) while the connections 112*a* and 112*f* can be interchanged, the latter two being shown as 212*f* and 212*a* in FIG. 2*b*.

Figure 2C:
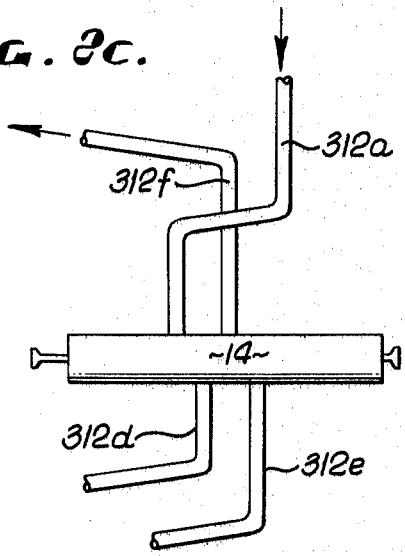

FIG. 2*c* indicates that the FIG. 2 arrangement of connections 12*d* and 12*e* to the metering cylinder can be retained (here those connections are identified as 312*d* and 312*e*, respectively) while the connections 12*a* and 12*f* can be interchanged, and are shown as 312*a* and 312*f* in FIG. 2*c*.

Figure 2D:
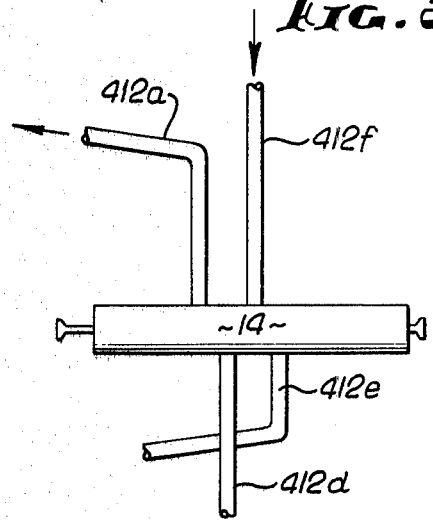

FIG. 2*d* indicates that the connections 12*a* and 12*f* of FIG. 2 can be retained (here they are identified as 412*a* and 412*f*) while the connections 12*d* and 12*e* can be interchanged (here they are identified as 412*e* and 412*d*).

The system operation external to the spool valve itself is not changed by any of these interchanges, though of course flow patterns within the spool are different, and in some of these configurations as will be apparent the pneumatic spool-drive connections may require reversal.

Comparison of FIGS. 2*a* through 2*d* with the correspondingly numbered figures of my previously mentioned patent shows that in each case the configuration of tubulation connections is simplified, with the attendant advantages already described.

Figure 2E:
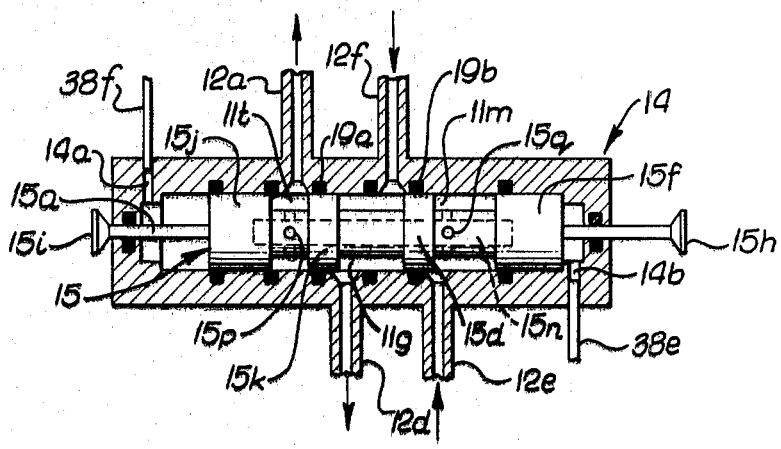

The spool extensions 15*a* and 15*h* shown in FIGS. 2 through 2*e* hereof, and identified in FIG. 2, serve the same functions as described in my previous patent, namely to indicate externally the position of the spool within the valve barrel and to provide a means for breaking free the spool in the event that cold flow of the seals (when the machine is not operating) produces more static friction than can be overcome by operation of the pneumatic drive system. The shafts 15*a* and 15*h* are sealed at 16 and 23 respectively by compliant seals. FIGS. 2 and 2*e* illustrate O-ring seals mounted in O-ring grooves within the spool-valve barrel internal surface, rather than in O-ring grooves in the outer surface of the spool as shown in FIG. 1. I find the arrangement of FIG. 1 preferable because machining of grooves in the outside of the spool is easier than in the inside surface of the barrel; however, the two configurations are in a functional sense generally equivalent.

Not all embodiments within the scope of the appended claims, of course, are described or illustrated hereinabove. For example, the spool 115 of FIG. 1 is illustrated with dual O-rings 121*b* and 121*c*, sealing the land 115*k* against the cylindrical surface 114*h*; and dual O-rings 121*d* and 121*e*, sealing the land 115*d* against the cylindrical surface 114*h*. These dual seals are necessary to prevent "crossflow" between adjacent ports while the spool is being shifted between its fully-leftward and fully-rightward positions. In many embodiments of my valve configuration, such as air-cylinder controllers for instance, a small amount of fluid crossflow during shifting of the spool is not objectionable; in such applications it is sufficient to provide a single O-ring seal for each of the two lands 115*k* and 115*d*.

I claim:

1. A system for filling containers with flowable substance from a source thereof, comprising:

a dispensing nozzle, connected to receive such substance from the source along a flow path, for discharging such substance into each such container;

metering means, connected to the supply and upstream of the nozzle, adapted to premeasure, at a flow rate determined in part by an orifice along the flow path within the metering means, the volume of such substance discharged along the flow path from the source into each such container;

flow-rate control means, disposed within the metering means and activated in response to discharge of a specified fraction of the said volume of substance into each container as established by the internal operation of the metering means, for restricting said orifice and thereby restricting the flow rate of such substance.

2. A system for filling containers with flowable substance from a source thereof, comprising:

a volumetric metering chamber adapted to be connected to receive such substance from the source and having an inner cylindrical surface terminating in at least one shaped end wall;

a port formed in the chamber at the same end of the chamber as the said wall;

a bi-acting metering piston positioned within the chamber, and adapted for motion therein toward and away from said one end wall, to meter predetermined volumes of such substance into and out of the chamber, via the port, to such containers, and having an end surface facing said one end wall;

flow-rate control means, actuated in response to proximity of the end surface of the piston to the said one end wall of the cylinder, for restricting the flow rate of such substance through the port when the said surface is within a specified distance of the said one end wall.

3. The system of claim 2, also comprising adjustable means for establishing the fluid flow rate when the said end surface is within the said specified distance, the adjustable means being adjustable even during operation of the system.

4. The system of claim 2 wherein the flow-rate control means comprise a flow-limiting element, compliantly supported from the end surface of the piston and adapted and positioned to engage the port when the end surface is at said specified distance from the said one end wall.

5. The system of claim 4, also comprising adjustable means for establishing the fluid flow rate when the said end surface is within the said specified distance, the adjustable means being adjustable even during operation of the system.

6. The system of claim 4 wherein:

a recess is formed in the said one end wall of the cylinder at the location of the port; and the flow-limiting element is an annulus which engages the recess, permitting flow only through the orifice of the annulus when the annulus is in engagement with the recess, the orifice being of smaller cross-sectional area than the port.

7. The system of claim 6, also comprising adjustable means for establishing the fluid flow rate when the said end surface is within the said specified distance, the adjustable means being adjustable even during operation of the system;

said adjustable means comprising a movable element mounted in the said end wall and projecting inwardly toward engagement with the orifice of the annulus, and adjustable from the outside of said one end wall even during operation of the system.

8. The system of claim 7 wherein the orifice of the annulus is circular, and the said movable element is a screw, which has a beveled tip and which is threaded through the said one end wall into the port and the recess, and aligned for engagement of the tip with the said orifice, the head end of the screw being toward the outside of the said one end wall and being rotatable from the outside of the said end wall even during operation of the system.

9. A system for filling containers with flowable substance, comprising:

supply means for storing a supply of such substance under pressure;

means defining a cylindrical chamber and at least one port at each end thereof;

a piston closely and slidably fitted within the chamber for motion between predetermined limits;

compliant means for effecting a sliding seal between the inner surface of the chamber and the outer surface of the piston, whereby the piston forms a movable wall cooperating with the first-mentioned defining means to define first and second subchambers, each having at least one port;

dispensing means for conducting such substance into such containers; and valve means comprising:

means defining a cylindrical barrel and four ports therein, for passage of such substance, spaced along the length thereof;

a spool closely and slidably fitted within the barrel, and having at least three fluid-transmitting portions spaced along its length, and having an internal passage communicating with a particular two of the three fluid-transmitting portions of the spool; the spool having at least two stable positions longitudinally within the barrel;

means for driving the spool between the two stable positions in response to arrival of the piston in the chamber at the said predetermined limits; and means for effecting connection between the supply means, the ports of the valve barrel, the ports of the subchambers, and the dispensing means whereby:

during a first half-cycle of operation, with the spool in one of its two stable positions, the valve provides physical communication between the first subchamber and the supply means, whereby pressurized substance from the supply means entering the first subchamber forcibly moves the cylinder, enlarging the first subchamber and reducing the second subchamber; and the valve provides physical communication between the second subchamber and the dispensing means, whereby reduction of the second subchamber forcibly moves such substance out of the second subchamber to the dispensing means; and during a second half-cycle of operation, with the spool in the other of its two stable positions, the valve provides physical communication between the second subchamber and the supply means, whereby pressurized substance from the supply means entering the second subchamber forcibly moves the cylinder, enlarging the second subchamber and reducing the first subchamber; and the valve provides physical communication between the first subchamber and the dispensing means, whereby reduction of the first subchamber forcibly moves such substance out of the first subchamber to the dispensing means.

10. The valve of claim 9, wherein the fluid-transmitting portions comprise longitudinal sections of the spool whose diameter is substantially smaller than the inside diameter of the barrel, whereby the said sections form with the inside of the barrel annular cavities adapted for passage of fluid.

11. The system of claim 9 wherein, when the spool is in one of the said two stable positions, such substance flows into the barrel through one of said four ports into one of the said particular two fluid-transmitting portions, along the central bore, into the other one of the said particular two fluid-transmitting portions and out of the barrel through another one of said four ports; while such substance also, without passing through the central bore, flows between the other two of said four ports via a fluid-transmitting portion of the spool which is not one of the said particular two fluid-transmitting portions.

12. The valve of claim 11, wherein the fluid-transmitting portions comprise longitudinal sections of the spool whose diameter is substantially smaller than the inside diameter of the barrel, whereby the said sections form with the inside of the barrel annular cavities adapted for passage of fluid.

13. The system of claim 11, also comprising sealing means providing compliant seal of the spool circumference, between its fluid-transmitting portions, with the internal wall of the barrel, the fluid-transmitting portions being so spaced along the length of the spool and the ports being so spaced along the length of the barrel that flow from either of the first two ports mentioned in claim 10 to either of the other two ports is effectively eliminated, when the spool is in the position specified in claim 10.

14. The valve of claim 13, wherein the fluid-transmitting portions comprise longitudinal sections of the spool whose diameter is substantially smaller than the inside diameter of the barrel, whereby the said sections form with the inside of the barrel annular cavities adapted for passage of fluid.

15. A device for impelling flowable substance with limited velocity, comprising:

a piston having an end-surface which impels such flowable substance;

a wall which faces the end-surface of the piston and which defines a port through which the piston impels such flowable substance;

a compliant supporting member attached to and movable with the end-surface of the piston;

a flow-limiting element, compliantly supported from the end-surface of the piston by means of the compliant supporting member, and adapted and positioned to engage the port, in such a way as to limit the cross-sectional area of the port, when the end-surface is at a specified distance from the wall;

whereby the velocity of the piston near the end of its stroke is made lower than in other phases of the stroke.

16. The device of claim 15 wherein:

a recess is formed in the wall at the location of the port; and the flow-limiting element is an annulus which engages the recess, permitting flow only through the orifice of the annulus.

17. The device of claim 16, also comprising adjustable means for establishing the fluid flow rate when the end-surface is within the said specified distance, said adjustable means being adjustable even during operation of the piston; and said adjustable means comprising a movable element mounted in the wall and projecting inwardly toward engagement with the orifice of the annulus, and adjustable from the other side of the wall even during operation of the system.

18. The device of claim 17 wherein the said orifice is circular and the said movable element is a screw, which has a beveled tip and which is threaded through the said wall into the port and the recess and is aligned for engagement of the tip with the said annulus, the head end of the screw being toward the other side of the wall from the annulus and being rotatable from said other side even during operation of the piston.

19. A valve for regulating direction of fluid flow, comprising:

means defining a barrel and four ports therein, for passage of such fluid, spaced along the length thereof;

a spool closely and slidably fitted within the barrel, and having at least three fluid-transmitting portions spaced along the length of the spool, and having an internal passage which communicates with a first and second of the three fluid-transmitting portions of the spool; the spool having at least two stable positions longitudinally within the barrel; and means for driving the spool between the two stable positions in response to a requirement to change the direction of fluid flow;

the said three fluid-transmitting portions and the four ports being so spaced apart and so sized in mutual relation as to provide:

when the spool is in one of its two stable positions, physical communication between a first one of said four parts and a second one of said four ports, via: the said first fluid-transmitting portion, the internal passage, and said second fluid-transmitting portion, in that order; and simultaneously physical communication between a third one of said ports and the fourth one of said ports, via the third fluid-transmitting portion of the spool, without passing through the internal passage; and when the spool is in the other of its two stable positions, physical communication between the said first one of said four ports and one of the third and fourth ports, via one of the fluid-transmitting portions, without passing through the internal passage; and simultaneously physical communication between the said second one of said four ports and the other one of the third and fourth ports, via a different one of the fluid-transmitting portions, without passing through the internal passage.

20. The valve of claim 19, wherein the fluid-transmitting portions comprise longitudinal sections of the spool whose diameter is substantially smaller then the inside diameter of the barrel, whereby the said sections form with the inside of the barrel annular cavities adapted for passage of fluid.

21. The valve of claim 19, also comprising:

compliant means for effecting a sliding seal between the inner surface of the barrel and the outer surface of the spool, between the fluid-transmitting portions of the spool;

the said necked-down portions and the four ports being so spaced apart and so sized in mutual relation that:

when the spool is in the said one of its two stable positions, physical communication is effectively eliminated between the said first one of said four ports and both of the said third and fourth ports; and between the said second one of said four parts and both of the said third and fourth parts; and when the spool is in the other of its two stable positions, physical communication between the said first and second ports is effectively eliminated; and physical communication between the said third and fourth ports is effectively eliminated.

22. The valve of claim 21, wherein the fluid-transmitting portions comprise longitudinal sections of the spool whose diameter is substantially smaller than the inside diameter of the barrel, whereby the said sections form with the inside of the barrel annular cavities adapted for passage of fluid.

23. A valve for controlling fluid flow, comprising:

a barrel and ports spaced along the length of the barrel; and a spool closely fitted within the barrel and adapted to slide longitudinally within the barrel between at least two functional positions;

the spool defining at least three fluid-transmitting portions spaced along the length of the spool, the spool also defining an internal passage providing communication between a particular two of the three fluid-transmitting portions;

the third fluid-transmitting portion being spaced between the said particular two, along the length of the spool, and having no direct communication with the passage; and the said particular two fluid-transmitting portions being so shaped and so spaced along the length of the spool, in relation to the spacing of the ports along the length of the barrel, that when the spool is in one of the said positions it provides physical communication between two of the ports via the said passage, bypassing the said third fluid-transmitting portion.

24. The valve of claim 23, wherein the passage comprises a substantially central, substantially longitudinal bore and substantially radial orifices between the bore and the particular two fluid-transmitting portions.

25. The valve of claim 23, wherein the fluid-transmitting portions comprise longitudinal sections of the spool whose diameter is substantially smaller than the inside diameter of the barrel, whereby the said sections form with the inside of the barrel annular cavities adapted for passage of fluid.

26. The valve of claim 23 also comprising:

compliant sealing means providing seal of the spool circumference, between its fluid-transmitting portions, against the internal wall of the barrel; and the fluid-transmitting portions being so sized and so spaced along the length of the spool, in relation to the ports, that the sealing means substantially eliminate physical communication between the said third fluid-transmitting portion and each of the said particular two fluid-transmitting portions, when the spool is in either of the two functional positions and any position between the two.

27. A valve for reversing fluid flow in a fluid path between a source of the fluid and a discharge point for the fluid, comprising:

a barrel defining ports spaced along the length of the barrel, including:

a first port for receiving fluid from the source, a second port for directing fluid to the discharge point, and third and fourth ports connected to the fluid path;

a spool closely fitted within the barrel and adapted to slide longitudinally within the barrel between at least two functional positions;

the spool defining at least three fluid-transmitting portions spaced along the length of the spool and an internal passage communicating between the two most-remote of the three portions but not with the third, intermediate portion;

compliant sealing means providing seal of the spool circumference, between its fluid-transmitting portions, against the internal wall of the barrel, the fluid-transmitting portions being so sized and so spaced along the length of the spool, in relation to the barrel ports, that:

when the spool is in a first of its two functional positions the fluid passes through the internal passage and flows in a first direction in the fluid path;

when the spool is in the second of its two functional positions the fluid does not pass through the internal passage but flows in the fluid path in a second direction opposite to the first direction; and in neither of the two functional positions of the spool, and in no position of the spool between the two functional positions, can fluid flow between the first and second ports without flowing along the fluid path.

28. A valve for controlling fluid flow in a fluid path between a source of the fluid and a discharge point for the fluid, comprising:

a barrel, defining exactly four functional fluid-flow ports spaced along the length of the internal surface of the barrel, said four ports being:

a first port for receiving fluid from the source, a second port for directing fluid to the discharge point, and third and fourth ports connected to the fluid path;

a spool closely fitted within the barrel and adapted to slide longitudinally within the barrel between at least two functional positions;

the spool defining at least three fluid-transmitting portions spaced along the length of the spool;

compliant sealing means providing seal of the spool circumference, between its fluid-transmitting portions, against the internal wall of the barrel;

the fluid-transmitting portions being so sized and so spaced along the length of the spool in relation to the barrel ports, that:

when the spool is in a first of its two functional positions the fluid flows in a first direction in the fluid path;

when the spool is in the second of its two functional positions the fluid flows in the fluid path in a second direction opposite to the first direction; and in both of the two functional positions of the spool, and in all positions of the spool between the two functional positions, the compliant sealing means prevent fluid from flowing between the first and second ports without flowing along the fluid path.

29. The valve of claim 28 wherein the compliant sealing means comprise, between at least one pair of adjacent fluid-transmitting portions, a pair of compliant seals substantially fixed to and movable with the spool and spaced apart along the length of the spool at least enough to span the effective dimension, along the length of the barrel, of one of the ports.

30. A valve for controlling fluid flow, comprising:

a barrel having an internal surface, and at least four ports spaced along the length of the internal surface;

a spool closely fitted within the barrel and adapted to slide longitudinally within the barrel between at least two functional positions;

the spool having seals which seal it slidably against the internal surface;

the spool defining fluid-transmitting portions which:

when the spool is in one of its two functional positions, provide physical communication between a first and a second of the four ports, and between a third and a fourth of the four ports; and when the spool is in the other of its two functional positions, provide physical communication between the first and fourth of the four ports, and between the second and third of the four ports; and the fluid-transmitting portions and seals being so spaced and sized along the spool that:

when the spool is in a particular intermediate position between the two functional positions, all flow through the valve is precluded;

when the spool is in the said one of its two functional positions, or any position between that said one and the intermediate position, flow is precluded between the first and third, between the first and fourth, between the second and third, and between the second and fourth ports; and when the spool is in the said other of its two functional positions, or any position between that said other position and the intermediate position, flow is precluded between the first and second, between the first and third, between the second and fourth, and between the third and fourth ports.

31. The valve of claim 30 wherein the seals comprise, between at least one pair of adjacent fluid-transmitting portions, a pair of compliant seals substantially fixed to and movable with the spool and spaced apart along the length of the spool at least enough to span the effective dimension, along the length of the barrel, of one of the ports.

* * * * *